United States Patent [19]

Ballantyne

[11] 4,229,122

[45] Oct. 21, 1980

[54] HOLE FILLING AND SEALING METHOD AND APPARATUS

[75] Inventor: James W. Ballantyne, Shelby, Mont.

[73] Assignee: Toole Energy Company, Inc., Shelby, Mont.

[21] Appl. No.: 949,961

[22] Filed: Oct. 10, 1978

[51] Int. Cl.[3] ..... E02D 15/00

[52] U.S. Cl. ..... 405/258; 166/253; 405/240

[58] Field of Search ..... 405/240, 241, 242, 236, 405/303; 166/285, 290, 287, 253

[56] References Cited

U.S. PATENT DOCUMENTS

| | | | |
|---|---|---|---|
| 2,171,840 | 9/1939 | Armentrout et al. | 166/253 |
| 2,231,577 | 2/1941 | Hare | 166/253 |
| 3,116,793 | 1/1964 | McStravick | 166/285 |
| 3,130,552 | 4/1964 | Bodine | 405/240 X |
| 3,391,544 | 7/1968 | Daczko | 405/241 |
| 3,485,052 | 12/1969 | Turzillo | 405/241 |
| 3,657,894 | 4/1972 | Parez | 405/241 |
| 4,045,966 | 9/1977 | Rusche | 405/240 |
| 4,120,166 | 10/1978 | Brooks | 166/253 X |

*Primary Examiner*—Dennis L. Taylor
*Attorney, Agent, or Firm*—Arthur L. Urban

[57] ABSTRACT

A method of filling and sealing a hole extending a great distance into the earth and containing liquid contaminants, the steps comprising forming a cement slurry, continuously pumping the cement slurry through a conduit extending to the bottom of the hole, continuously forcing the cement slurry from the open end of the conduit while the conduit is being withdrawn from the hole, continuously monitoring the level of the cement slurry within the hole, controlling the rate of withdrawal of the conduit so as to maintain the open end thereof below the level of the cement slurry being deposited within the hole, and removing the contaminants from the opening of the hole as they are displaced by the cement slurry being deposited therein. Also, apparatus suitable for conducting the above method.

7 Claims, 2 Drawing Figures

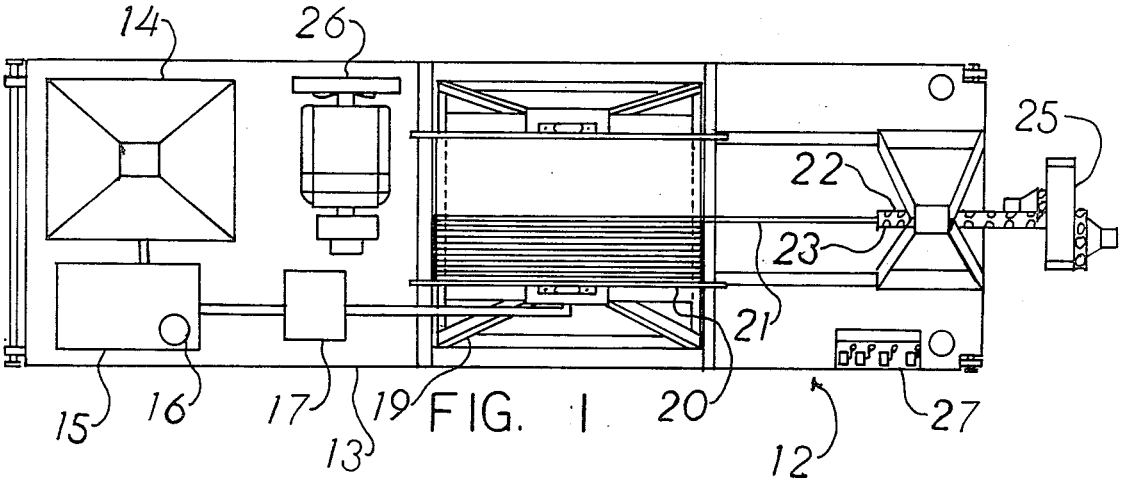
FIG. 1
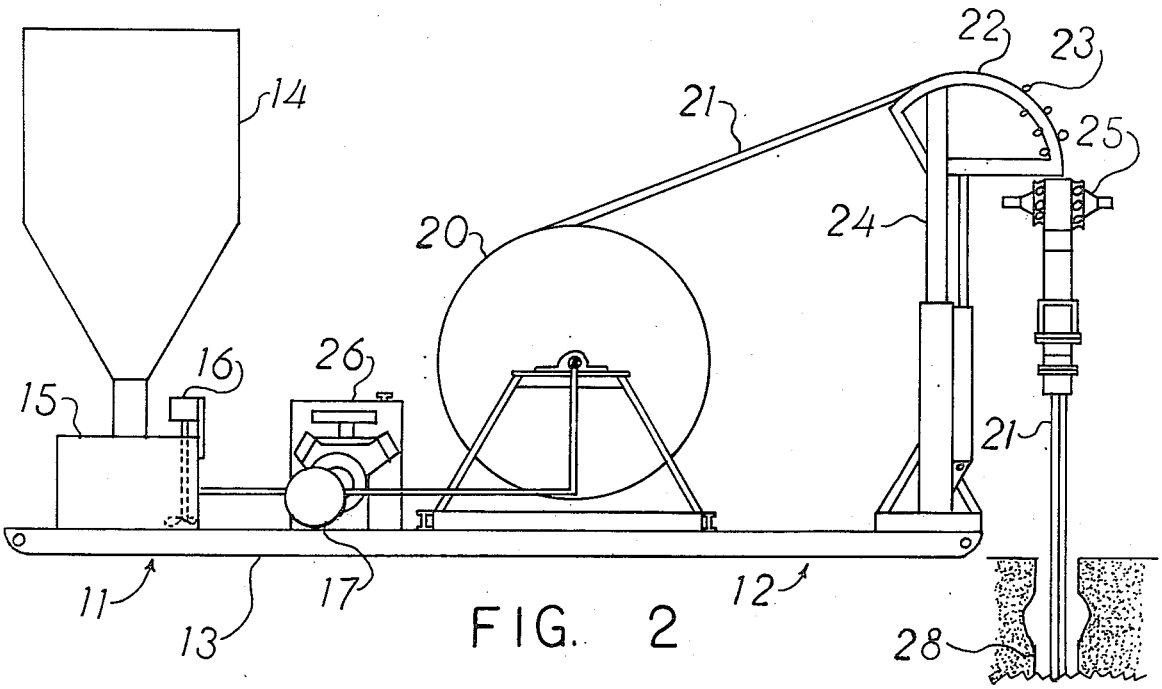
FIG. 2
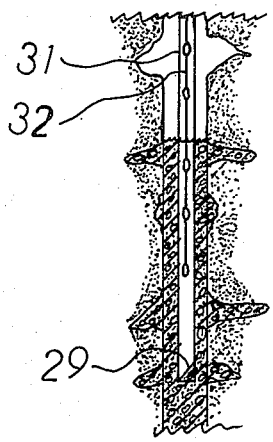

HOLE FILLING AND SEALING METHOD AND APPARATUS

This invention relates to a novel method and apparatus for filling and sealing holes extending deeply into the earth and more particularly relates to a new method and apparatus for continuously filling and sealing deep holes.

In the drilling of holes into the earth, it sometimes is necessary to refill the hole after the purpose for which the drilling was conducted has been accomplished. If the hole is of sufficient diameter and not very deep, the refilling operation can be done with conventional backfilling equipment such as backhoes and the like.

However, if the hole is relatively small in diameter, less than one foot or so, and/or has a depth of several hundred or thousand feet, conventional backfilling machinery and methods cannot be used successfully. In the drilling of wells and particularly oil wells, the diameter of the well hole may be as small as four inches and the depth may be thousands of feet. Such holes obviously cannot be filled and sealed with conventional backfilling equipment.

Presently, deep wells are filled and sealed by lowering a section of pipe with a length of about 30 feet into the hole. When the section has been inserted into the hole to almost its full length, a second section is fastened to the end of the first and the two lowered into the hole. A third section is then connected to the exposed end of the second section and the three sections lowered further into the hole. These connecting and lowering steps are repeated until the end of the pipe reaches the bottom of the well hole. It is apparent that a great deal of time and labor is required to insert a string of pipe into a hole, particularly a deep hole. To reach a depth of 1200 feet would require that the lowering of the pipe string be stopped for connection of a section of pipe forty times if each section is thirty feet.

When the end of the pipe reaches the bottom, sufficient cement is forced down the pipe string to fill the hole to a maximum depth of about 300 feet. The pipe string then is pulled up the hole to the desired level with the thirty foot pipe sections being removed from the string at the surface, one at a time. Before plugging the next portion of the hole, contaminated cement must be topped off. This contamination of the cement occurs as the pipe is pulled from the cement already in place. Ordinarily, it takes a minimum of about four hours for setting up and topping off each portion of the well that is cemented.

While the above method may be used successfully to fill and seal a hole if a high degree of care is exercised, the method still leaves much to be desired. The method is very time consuming since the raising of the pipe string must be stopped to remove each length of pipe. Removal of the lengths of pipe also requires a great deal of labor. More importantly, the intermittent withdrawal of the pipe string necessitates that the cement in the hole be topped off before beginning the pumping of the slurry into the hole again. If the topping off is not done or not done properly, the cement will stratify along the length of the hole and not produce complete filling of the hole. This stratification along the length of the hole will result in inadequate sealing of the hole so that vapors and/or liquids may be able to escape from the adjacent ground formations through the filled hole to the surface.

The present invention provides a novel method and apparatus for filling and sealing a hole extending deep into the ground. The method and apparatus of the invention provide complete filling of the hole without gaps or stratification. This complete filling of the hole provides a sealing thereof so that vapors and liquids cannot escape to the surface. The method and apparatus of the invention provide for the filling and sealing of a hole in a relatively short time period. Also, the method and apparatus enable only a few men to accomplish the filling and sealing operations.

Furthermore, the method and apparatus of the present invention provide continuous monitoring and control of the hole cementing operation. Moreover, the method of the invention utilizes conventional technology which enables the method to be conducted after a minimum of instruction. Also, the personnel involved do not need to have special educational background or skills. In addition, the apparatus of the invention can be fabricated from commercially available components and materials.

Other benefits and advantages of the novel method and apparatus of the present invention will be apparent from the following description and the accompanying drawings in which:

FIG. 1 is a top view of a schematic illustration of one form of the hole filling and sealing apparatus of the invention; and FIG. 2 is a side view of the schematic illustration of the hole filling and sealing apparatus shown in FIG. 1.

The novel method of filling and sealing a hole extending a great distance into the earth and containing liquid contaminants and/or solid contaminants comprises the steps of forming a cement slurry, continuously pumping the cement slurry through a conduit extending to the bottom of the hole, continuously forcing the cement slurry from the open end of the conduit while the conduit is being withdrawn from the hole, continuously monitoring the level of the cement slurry within the hole, controlling the rate of withdrawal of the conduit so as to maintain the open end thereof below the level of the cement slurry being deposited within the hole, and removing the contaminants from the opening of the hole as they are displaced by the cement slurry being deposited therein.

One form of the novel apparatus of the present invention as shown in the drawings includes a cement slurry forming section 11 and hole filling and sealing section 12 mounted on a common supporting frame 13. The frame 13 may be supported on a trailer (not shown) or the frame itself may be a skid as shown which may be placed on a trailer for transport when required. If desired, the cement slurry forming section 11 may be mounted on a separate supporting frame from that on which the hole filling and sealing section is mounted.

Cement slurry forming section 11 includes a hopper 14 and a mixer 15 with an agitator 16. A pump 17 transfers the cement slurry formed in mixer 15 through delivery line 18 to the hole filling section 12.

Hole filling section 12 includes a drum support stand 19 mounted on frame 13. A drum 20 having a coil of conduit or tubing 21 wound thereon is rotatably carried by stand 19. Conduit 21 passes over an arcuate guide member 22 having a plurality of rollers 23. Guide member 22 is mounted on a frame 24 which is designed to retract the guide member when apparatus is being moved to a different location.

Below the delivery end of guide member 22 is disposed a tubing injector 25. An internal combustion engine 26 mounted on frame 13 drives agitator 16, pump 17, drum 20 and injector 25, either directly or more advantageously through a hydraulic system (not shown) and controls 27.

Conduit 21 extends through injector 25 downwardly into well hole 28 to the bottom thereof. The open end 29 of the conduit 21 advantageously is cut at an angle to provide an open orifice for the delivery of the cement slurry even when the end of the conduit is against the bottom of the hole.

The position of the open end 29 of the conduit 21 with respect to the level of the cement in the hole is monitored by means shown as a plurality of sensing elements 31 affixed to the bottom portion of the conduit. The sensing elements advantageously are operatively connected such as with lead wire 32 to instrumentation (not shown) disposed with controls 27 of the apparatus. Preferably, as shown, sensing elements 31 are spaced at intervals along the bottom portion of the conduit 21.

In conducting the method of the present invention utilizing the apparatus shown in the drawings, the apparatus is moved into position over well hole 28. Frame 13 is positioned so that guide member 22 can be extended on frame 24 so as to be located directly over hole 28. Conduit 21 then is withdrawn from drum 20 and passed through guide 22 and the rollers 23 thereof and down through injector 25. The conduit 21 is inserted down hole 28 until the open end 29 of the conduit is in contact with the bottom of the hole.

Cement from hopper 14 is transferred to mixer 15 and mixed with water therein with agitator 16. The resulting cement slurry is pumped with pump 17 through delivery line 18 into the center of drum 20 and into the conduit 21. The cement slurry is pumped through the coils of conduit 21 wound on drum 20 and through the portion of the conduit extending down into well hole 28 to the open end 29 of the conduit. The cement slurry is forced from open end 29 and is deposited in the bottom of the hole. The continuing flow of the cement slurry from the conduit fills the hole bottom and causes the level of cement to rise in the hole.

As the level of the cement rises in the hole, the level will pass the position of the sensing element 31 which is lowest on the conduit 21. As the lowest sensing element 31 is submerged within the cement slurry, the sensing element will send a signal through wire 32 to instrumentation disposed with controls 27. An operator stationed at controls 27 observing the instrumentation is made aware of the level of the cement in the hole.

The operator then can make a decision as to when to begin the withdrawal of the conduit from the bottom of the hole. Either he can wait until the level of the cement slurry passes and rises above one of the sensing elements located above the lowest sensing element or he can begin the withdrawal of the conduit when the cement level rises above the lowest element.

The withdrawal of the conduit 21 from the hole, in any case, will be controlled by the operator so as to maintain the open end 29 of the conduit below the level of the cement slurry being deposited within the hole. The operator can be sure that this is occurring as he continuously monitors the level of the cement slurry by means of the signals from sensing elements 31 disposed at the bottom portion of the conduit. To ensure that the level of the cement slurry is above the open end of the conduit, the operator may maintain more than one of the sensing elements below the surface of the cement slurry. This gives the operator a margin of error in the operation of his equipment.

The sensing elements 31 may sense any of a variety of conditions to signal contact of the element with the cement slurry. For example, the sensing elements may sense a difference in temperature as cement contacts each element. Also, the sensing elements may sense one or more of the chemical constituents of the cement slurry, e.g., chloride, etc.

As the cement slurry is deposited in the bottom of the well hole 28, the slurry will displace some of the contaminants within the hole. This forces a portion of the contaminants from the opening of the hole at the surface. These contaminants may be removed from the opening by pumping the material away, by draining the material from the opening or by other suitable disposal methods.

Since the well hole ordinarily will have sections of somewhat larger diameter due to fissures in the formations or other ground conditions, the rate at which the conduit is withdrawn from the hole will vary. Where the diameter is quite large, the conduit may be motionless for a period while the cement slurry being forced from the open end of the conduit completely fills and seals the enlarged section. Conversely, the conduit may be moved much more rapidly through sections of small diameter. Thus, it is essential that the operator be able to monitor continuously the position of conduit end so that it is maintained below the surface of the cement slurry within the hole. By maintaining the conduit end below the level of the cement slurry and by continuously pumping the slurry into the hole, the complete filling and sealing of the hole can be achieved in a continuous operation without any interruptions for setting up or topping off of the cement.

The above description and the accompanying drawings show that the present invention provides a novel method and apparatus for filling and sealing holes extending deep into the ground. Complete filling and sealing of holes is achieved through utilization of the method and apparatus of the invention. The filling and sealing is achieved without gaps or stratification so that vapors and liquids cannot escape to the surface.

The method and apparatus of the present invention provide for continuous filling and sealing of a hole in a relatively short time period. In addition, the method and apparatus can perform the filling and sealing operations with a crew of only a few men. Moreover, the method and apparatus of the invention enable the operator or operators to monitor and control the cementing operation continuously.

Furthermore, the method of the invention utilizes technology that is commonly employed so the operator needs only a minimum of instruction to perform the filling and sealing operation. Also, the operator does not have to have special educational skills or background. In addition, the apparatus of the invention can be fabricated from commercially available components and materials.

It will be apparent that various modifications can be made in the particular method and apparatus described in detail and shown in the drawings within the scope of the invention. For example, additional steps may be added to the method provided they do not adversely affect the continuity of the cementing operation. Also, the size and configuration of the various components of the apparatus of the invention may be changed to meet specific requirements. Therefore, the scope of the present invention is to be limited only by the following claims.

What is claimed is:

1. A method of continuously filling and sealing a hole extending a great distance into the earth and containing liquid contaminants, the steps comprising forming a cement slurry, continuously pumping said cement slurry through a continuous conduit disposed in a coiled configuration on the surface of the earth with the free end thereof extending the entire distance to the bottom of said hole, continuously forcing said cement slurry from the open end of said conduit while said conduit is being withdrawn from said hole, continuously monitoring the level of said cement slurry within said hole remotely at a point adjacent that at which the withdrawal of said conduit from said hole is controlled, controlling the rate of withdrawal of said conduit so as to maintain the open end thereof below the level of the cement slurry being deposited within said hole, and removing the contaminants from said hole as they are displaced by the cement slurry being deposited therein.

2. A method according to claim 1 wherein the open end of said conduit is maintained a significant distance below the level of the cement slurry during withdrawal from said hole.

3. Apparatus for filling and sealing a hole extending a great distance into the earth and containing liquid contaminants, said apparatus including means for forming a cement slurry, a continuous coil of flexible conduit wound on a drum, means for delivering the open end of said conduit into said hole to the bottom thereof, means for conveying said cement slurry through said conduit and out the open end thereof into said hole, means associated with the bottom portion of said conduit including a plurality of sensing elements disposed on said conduit at spaced intervals from said open end of said conduit for monitoring the level of said cement slurry within said hole remotely at the surface of the earth, and means for withdrawing said conduit from said hole at a controlled rate and winding same onto said drum adjacent said monitoring means.

4. Apparatus according to claim 3 wherein the open end of said conduit is at an angle to the longitudinal axis of said conduit.

5. Apparatus according to claim 3 wherein said conduit is flexible steel tubing.

6. Apparatus according to claim 3 wherein said means for withdrawing said conduit from said hole includes an injector.

7. Apparatus according to claim 3 including at least one flat bed supporting frame on which the components of said apparatus are mounted.

* * * * *